US007090317B2

(12) United States Patent
Remmers

(10) Patent No.: US 7,090,317 B2
(45) **Date of Patent: *Aug. 15, 2006**

(54) WIRE BASKETS AND RELATED DEVICES

(75) Inventor: Lee E. Remmers, Ocala, FL (US)

(73) Assignee: Clairson, Inc., Newark, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/027,023

(22) Filed: Dec. 30, 2004

(65) Prior Publication Data

US 2005/0269921 A1 Dec. 8, 2005

Related U.S. Application Data

(63) Continuation of application No. 10/301,379, filed on Nov. 21, 2002, now Pat. No. 6,840,593.

(51) Int. Cl.
*A47B 88/00* (2006.01)

(52) U.S. Cl. ..... 312/330.1; 312/334.44; 312/334.27; 312/408; 312/410; 211/126.15

(58) Field of Classification Search ..... 312/334.44, 312/334.27, 330.1, 408, 410; 211/85.31, 211/126.9, 126.15
See application file for complete search history.

(56) References Cited

U.S. PATENT DOCUMENTS

| | | | | |
|---|---|---|---|---|
| 5,086,936 | A | 2/1992 | Remmers | |
| 5,303,997 | A | 4/1994 | Kropf | |
| 5,330,063 | A | 7/1994 | Remmers | |
| 5,980,009 | A | 11/1999 | Atalla et al. | |
| 6,467,860 | B1 | 10/2002 | Remmers | |
| 6,491,173 | B1 | 12/2002 | Costa | |
| 2002/0102034 | A1 * | 8/2002 | Holdredge | 384/34 |

* cited by examiner

*Primary Examiner*—Laurie K. Cranmer
(74) *Attorney, Agent, or Firm*—Harness, Dickey & Pierce, P.L.C.

(57) ABSTRACT

A wire basket includes a storage portion and base portion removably connected together and providing sliding operation. End caps connected to the storage portion are configured to allow for the removable connection. Glide members having a curved portion and connected to the base portion are configured to allow for the sliding operation.

36 Claims, 5 Drawing Sheets

WIRE BASKETS AND RELATED DEVICES

CROSS-REFERENCE TO RELATED APPLICATION

This application is a continuation of application Ser. No. 10/301,379, filed Nov. 21, 2002, now U.S. Pat. No. 6,840, 593, issued Jan. 11, 2005, the entire disclosure of which is incorporated herein by reference.

FIELD OF THE INVENTION

This invention relates generally to storage devices, and more particularly to a slidably mounted wire basket providing improved sliding movement.

BACKGROUND OF THE INVENTION

Storage devices, such as bins and baskets are often slidably mounted to allow better access to the interior for depositing and removing material. This sliding mounting is typically accomplished using wheels that are aligned with rails or other guiding mechanisms to provide such movement over a predetermined distance (e.g., forward and backward between stops provided on the ends of the rails). These wheels are prone to breakage and failure. It is difficult, particularly for consumers, to repair or replace these wheels, and thus users either must tolerate less than optimum performance, or spend the time and effort to replace the entire storage device.

Another shortcoming of many sliding storage devices is that their construction does not provide complete access to the interior. Still another shortcoming is that it can be difficult to remove the storage device from its sliding mounting, at least without disturbing the contents of the storage device.

SUMMARY OF THE INVENTION

A storage device constructed according to the principles of the present invention, and more particularly, a wire basket unit includes a storage portion removably connected to a base portion and having glide members for providing sliding operation (e.g., lateral movement) of the storage portion relative to the base portion. The base portion in combination with the glide members allow for removal of the wire basket from the base portion while maintaining the wire basket generally horizontal relative to the base portion.

Specifically, in one embodiment of the present invention, a wire basket unit includes a storage portion (e.g., wire basket) formed by a plurality of wire members and a base portion configured to provide sliding movement of the storage portion relative thereto. The base portion allows for removable connection of the storage portion to the base portion. The wire basket unit further may include a plurality of end caps connected to at least some of the plurality of wire members to provide the sliding movement and configured to allow for removal of the storage portion from the base portion while the storage portion can be maintained generally horizontal. The wire basket unit may also include a plurality of glide members attached to the base portion and configured to provide sliding movement.

In another embodiment of the present invention, a wire basket unit includes means for removably connecting a storage portion to a base portion, and means for providing sliding movement of the storage portion relative to the base portion. The means for removably connecting is configured to allow for removal of the storage portion from the base portion while maintaining the storage portion substantially horizontal. The wire basket unit may also include means for limiting the sliding movement of the storage portion relative to the base portion.

In another aspect, the invention provides end caps that can be used with storage devices, which have a base portion and a storage portion formed by a plurality of wire members. In one embodiment, an end cap generally includes a first curved portion for engagingly receiving a portion of one of the wire members. The end cap also includes a first opening for engagingly receiving a portion of another one of the wire members. The end cap is configured to facilitate sliding of the storage portion relative to the base portion when the end cap is engaged to the storage portion. Other aspects include storage devices having end caps and methods of using end caps.

Another aspect of the invention provides glide members that can be used with storage devices, which have a base portion and a storage portion formed by a plurality of wire members. In one embodiment, a glide member generally includes a mounting for attaching the glide member to the base portion. The glide member also includes a curved portion. The curved portion is configured to facilitate sliding movement of at least one of the wire members across the curved portion relative to the base portion without rolling of the glide member when the glide member is attached to the base portion. Other aspects include storage devices having glide members and methods of using glide members.

A further aspect of the invention provides storage systems that include a base portion and a storage portion formed by a plurality of wire members. The storage portion is removably and slidably mounted to the base portion. A plurality of end caps are connected to end portions of at least some of the wire members. The plurality of end caps are configured to allow for the removable connection of the storage portion to the base portion while the storage portion is maintained generally horizontal. The base portion includes rails for aligning the storage portion relative to the base portion during sliding movement. The rails include an offset portion for allowing passage of the ends caps for removably connecting the storage portion to the base portion.

Other aspects of the invention provide methods of slidably mounting a storage portion formed by a plurality of wire members to a base portion. In one embodiment, a method generally includes positioning a portion of one wire member within a curved portion of at least one end cap, positioning a portion of another wire member within an opening of the end cap, and positioning the end cap within a channel of the base portion. In another embodiment, a method generally includes attaching to the base portion at least one glide member having a curved portion configured to facilitate sliding of at least one of the wire members across the curved portion without rolling of the glide member.

Further areas of applicability of the present invention will become apparent from the detailed description provided hereinafter. It should be understood that the detailed description and specific examples, while indicating preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses. Although a wire basket of the present invention is described in connection with component parts configured in a particular manner for providing specific functionality, it is not so limited, and a wire basket of the present invention may include different or additional component parts configured differently to provide additional or different functionality.

Figure 1:
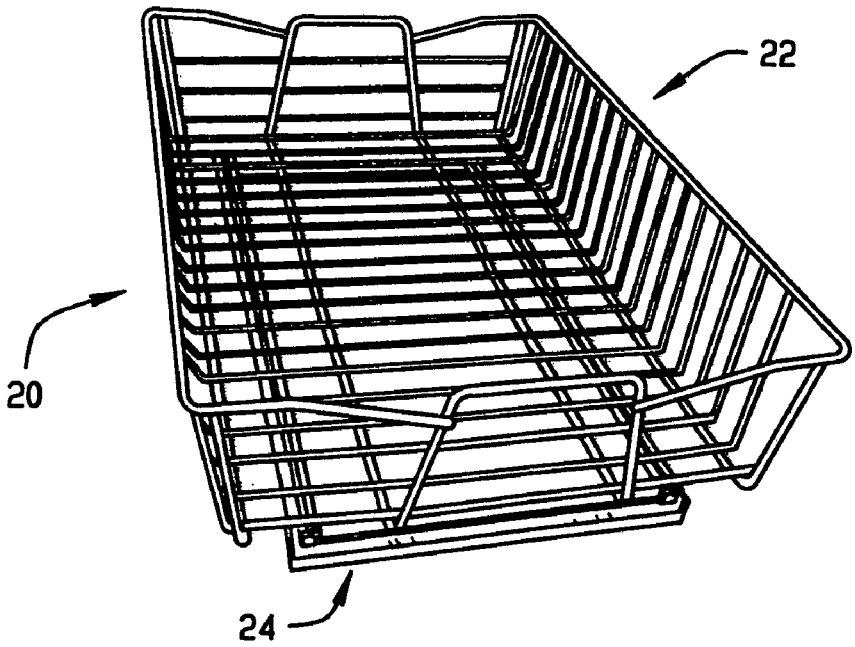
FIG. 1 is a top perspective view of a wire basket unit constructed according to the principles of the present invention.
Figure 2:
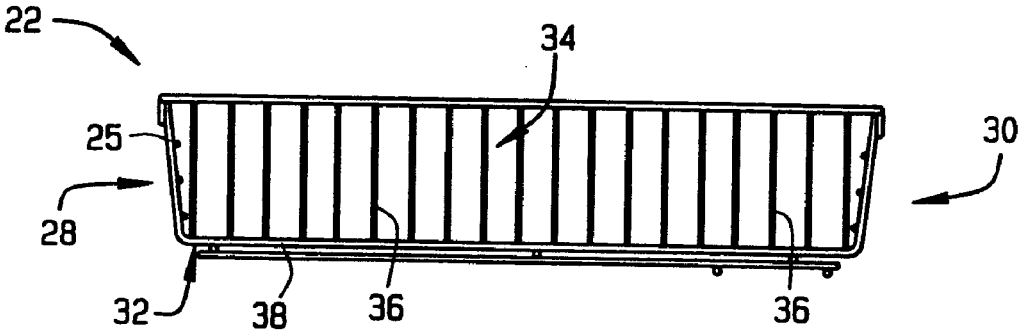
FIG. 2 is a side elevation view of the storage portion of a wire basket unit according to the present invention.
Figure 4:
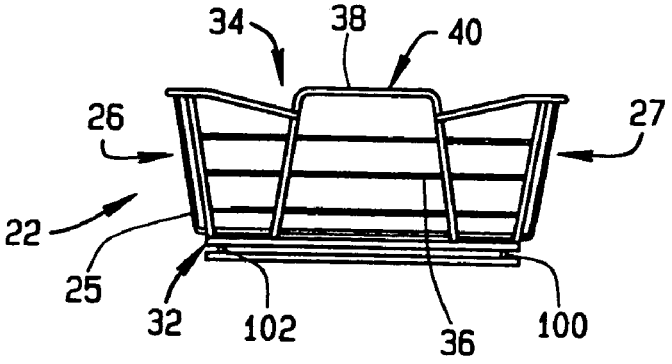
FIG. 4 is a front elevation view of the storage portion of a wire basket unit according to the present invention.
Figure 3:
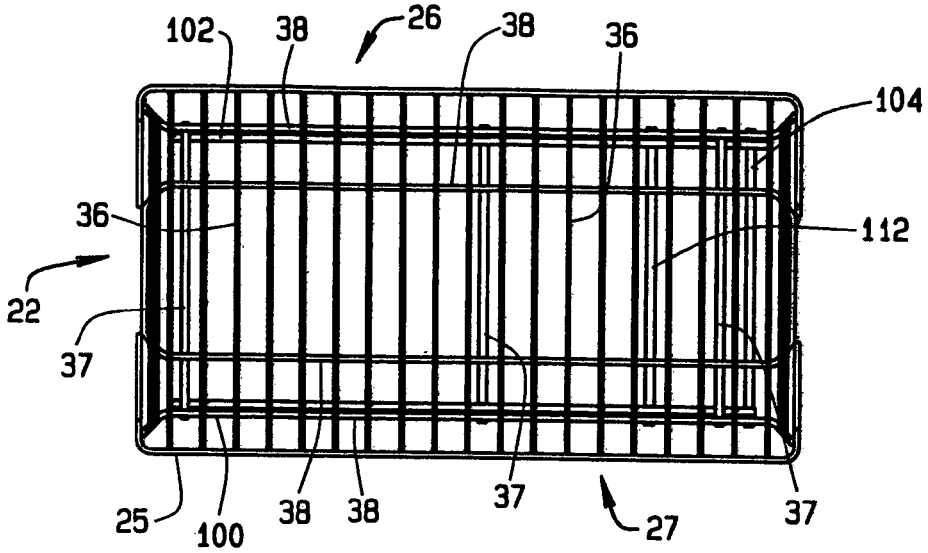
FIG. 3 is a top plan view of the storage portion of a wire basket unit according to the present invention.

Generally, and as shown in FIG. 1, a wire basket unit 20 constructed according to the principles of the present invention includes a storage portion 22 configured for removable connection to a base portion 24 to provide slidable operation. Specifically, in a preferred embodiment as shown in FIGS. 2 through 4, the storage portion 22 is a wire basket 25 including sides 26 and 27, a front 28, a back 30, and a bottom 32, together forming a storage volume 34. As shown, the sides 26 and 27, front 28, back 30, and bottom 32 are preferably formed by a plurality of wire members, including a plurality of transversely extending wires 36 (e.g., formed steel wires), a plurality of transversely extending wire support members 37, and a plurality of longitudinally extending wire support members 38. It should be noted that the transversely extending wire members 36 and/or longitudinally extending wire support members 38 may be configured such that a single transversely extending wire member 36 and/or longitudinally extending wire support member 38 forms more than one portion of the wire basket 25. For example, single transversely extending wire members 36 may be configured to form both the sides 26, 27 and the bottom 32.

Further, additional functionality may be provided to the wire basket 25. For example, the transversely extending wire members 36 and/or longitudinally extending wire support members 38 may be configured to form handles 40 and other features for use when removing the wire basket 25 from the base portion 24 or replacing it therewith. As shown in FIG. 4, a generally U shaped handle 40 is formed by two longitudinally extending wire support members 38 that are configured as a single wire. The handle 40 may be used by a user when removing the wire basket 25 from the base portion 24.

Figure 8A:
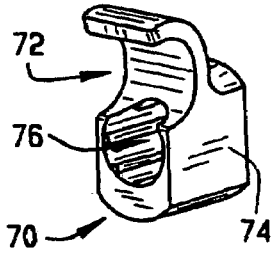
FIGS. 8(*a*) and 8(*b*) are front and rear perspective views of an end cap of the present invention.
Figure 8B:
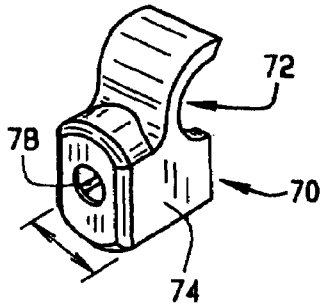
Figure 9:
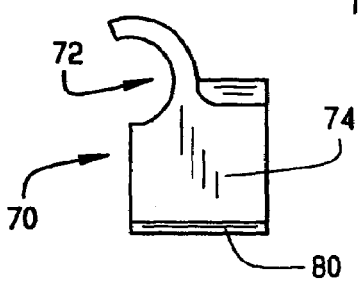
FIG. 9 is a side elevation view of the end caps of FIGS. 8(*a*) and 8(*b*)

End caps 70 are mounted on opposite ends of a wire member of the wire basket 25, and in particular, a first transversely extending storage portion support member 104. As shown in FIGS. 8 and 9, the end caps 70 have a curved portion 72, generally concave in this embodiment, which is configured for engagement with a first longitudinally extending storage portion support member 100 of the wire basket 25. The curved portion 72 is sized to receive therein a portion of the first longitudinally extending storage portion support member 100 (i.e., circumferentially the same size as the first longitudinally extending storage portion support member 100). Further, a lower portion 74 includes a first opening 76 configured for receiving therein the end of the first transversely extending storage portion support member 104 (i.e., circumferentially the same size) as described herein. A second opening 78 may also be provided in connection with the first opening 76 to allow for easier insertion of such first transversely extending storage portion support member 104 into the first opening 76 (e.g., to allow air to flow therethrough during insertion). The lower portion 74 is configured to include a curved bottom 80, generally convex in this embodiment, to facilitate sliding of the end cap 70 through the channel of the side supports 46, 47 of the base portion 24 as described herein. Further, the width (W) of the end cap 70, as shown in FIG. 8(*b*), is sized to allow for insertion into and removal from the base portion 24 using the offset portion 50 of the side supports 46, 47.

Figure 12:
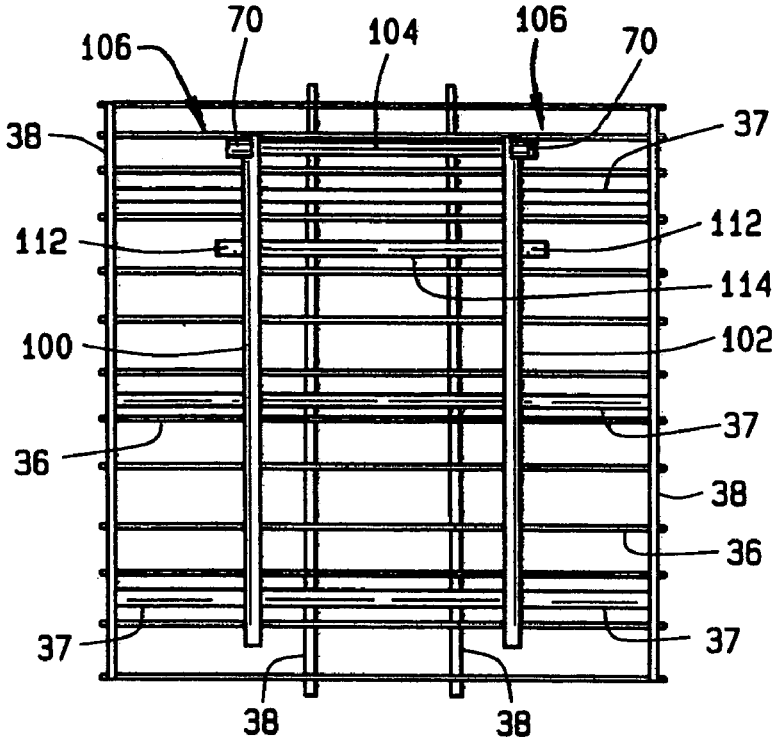
FIG. 12 is a partial plan view of the storage member of the wire basket unit of the present invention.
Figure 14:
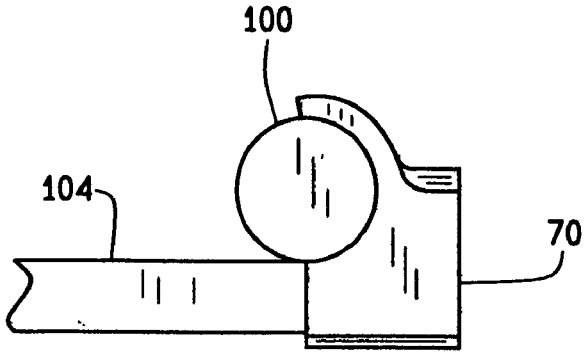
FIG. 14 is a partial side elevation view of an end cap of the present invention engaged to wire members of the storage portion of the wire basket unit according to the present invention.

Referring now to FIGS. 12 and 14, the end caps 70 are engaged with the wire basket 25 to allow for removable connection to the base portion 24 and to provide sliding movement thereof. Specifically, wire members, and in particular, the first longitudinally extending storage portion support member 100 and a second longitudinally extending storage portion support member 102 provide guides for maintaining the position of the wire basket 25 relative to the base portion 24 when connected thereto and sliding relative to each other. More specifically, the first and second longitudinally extending storage portion support members 100 and 102 provide alignment with and allow movement of the wire basket 25 across the curved portion 92 of the glide members 90.

The first transversely extending storage portion support member 104 is configured to allow engagement (e.g., connection) of the end caps 70 to ends 106 thereof. In particular, and as shown in FIG. 14, the end cap 70 is configured such that the first transversely extending storage portion support member 104 is inserted within the first opening 76 with the curved portion 72 surrounding and receiving therein a portion of the first longitudinally extending storage portion support member 100. In this embodiment, the first longitudinally extending storage portion support member 100 is perpendicularly connected to the first transversely extending storage portion support member 104, for example, by welding, and the end cap 70 is configured for engagement to these perpendicularly aligned members. It should be noted that the end cap 70 may be connected to the other end 106 of the first transversely extending storage portion support member 104 and the second longitudinally extending storage portion support member 102 in the same manner.

Figure 5:
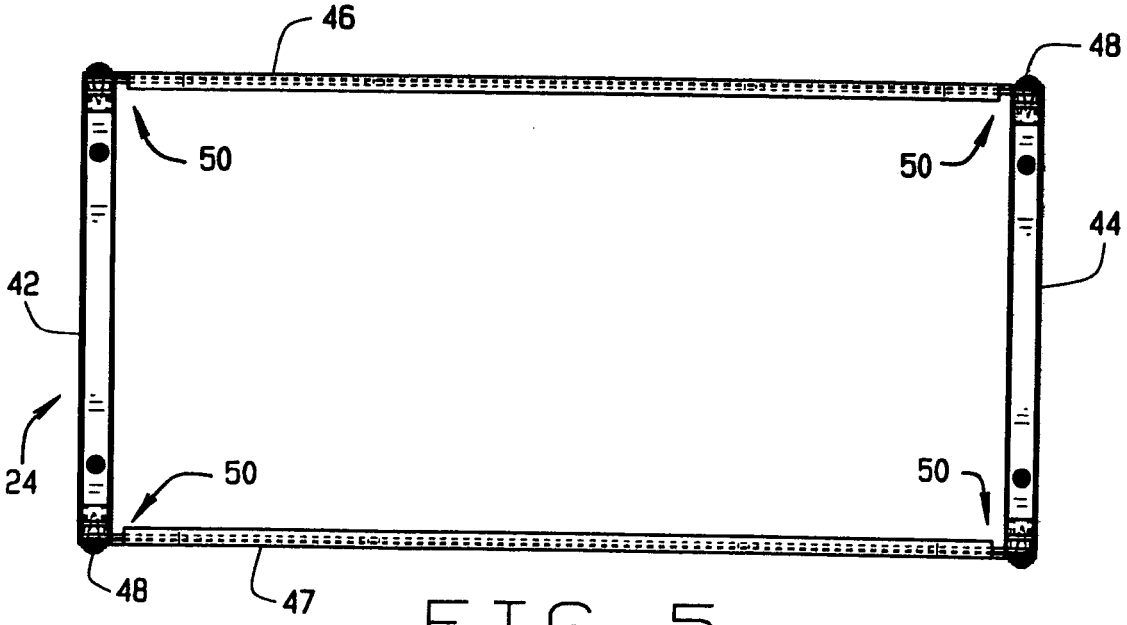
FIG. 5 is a top plan view of the base portion of a wire basket unit according to the present invention.
Figure 7:
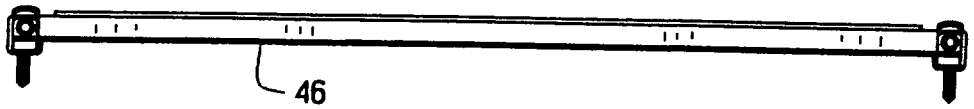
FIG. 7 is a side elevation view of the base portion of the wire basket unit according to the present invention.
Figure 6:
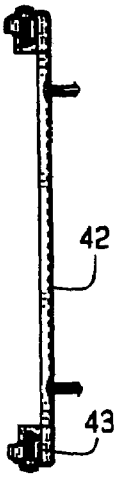
FIG. 6 is a front elevation view of the base portion of the wire basket unit according to the present invention.

Referring now to the base portion 24 as shown in FIGS. 5 through 7, the base portion 24 generally includes a front support 42, a rear support 44 and side supports 46, 47. In this embodiment, the side supports 46, 47 are configured as rails having channels (e.g., inwardly facing, generally C-shaped channels). The side supports 46, 47 are configured to provide for sliding movement of the storage portion 22 relative to the base portion 24 using the channels of the rails and as described in more detail herein. The front support 42, rear support 44 and side supports 46, 47 are connected together to form the base portion 24 using, for example, screws 48. Each of the side supports 46, 47 include on each of their ends an offset portion 50 configured for allowing passage (e.g., insertion) into the channels formed by the side supports 46, 47.

Figure 10A:
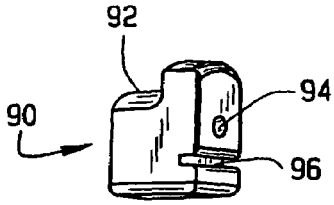
FIGS. 10(*a*) and 10(*b*) are perspective views of a glide member of the present invention.
Figure 10B:
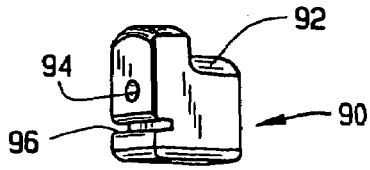
Figure 11:
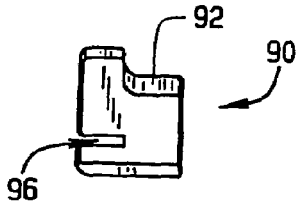
FIG. 11 is a side elevation view of a glide member of the present invention.
Figure 13:
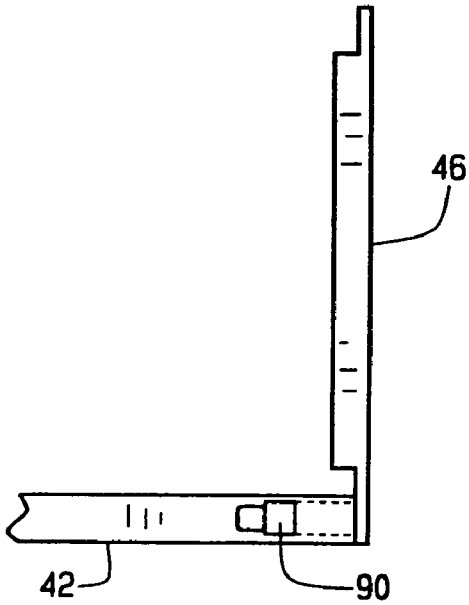
FIG. 13 is a partial top plan view of the base portion of the wire basket unit according to the present invention.

Referring now to FIGS. 10 and 11, a glide member 90 allows for sliding movement of the storage portion 22, and more particularly for providing sliding movement of the longitudinally extending wire support members 38, and in particular, the first and second longitudinally extending storage portion support members 100 and 102, of the bottom 32 of the wire basket 25 as it moves relative to the base portion 24. The glide member 90 includes a top curved portion 92, generally convex in this embodiment, for facilitating sliding movement. A mounting hole 94 is provided through the glide member 90 for mounting to and connecting the side supports 46 to either the front support 42 or rear support 44 as shown in FIGS. 5 and 13. Such connection may be provided, for example, using a screw 48 or similar connection member. Further, a slot 96 is provided for further securing the glide member 90 to the side support 46, and in particular, for inserting a bottom rail portion 43 of the side support 46 therein and as shown in FIG. 6.

Figure 16:
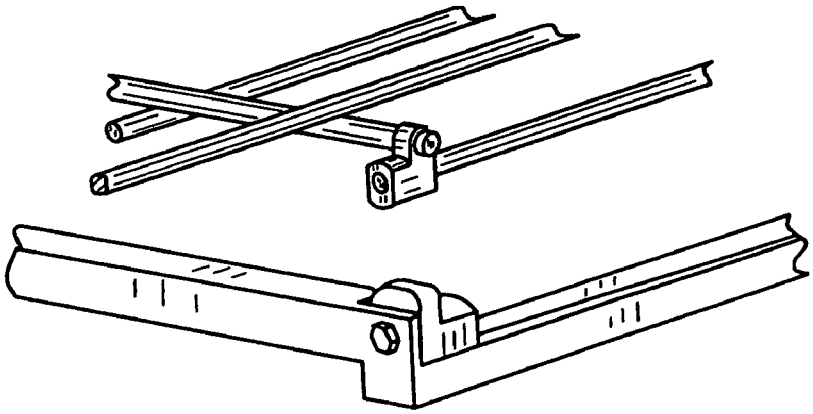
FIG. 16 is a partial perspective view of a wire basket unit of the present invention illustrating the removable connection of the storage portion to the base portion.

Thus, in operation, the end caps 70 are inserted through the offset portions 50 as shown in FIG. 16 to removably connect the wire basket 25 to the base portion 24 and provide for sliding operation of the wire basket 25 relative to the base portion 24. It should be noted that the ends 112 of a second transversely extending storage portion support member 114 are also inserted through the offset portions 50 as the wire basket 25 moves towards the rear support 44 and act as stops when the wire basket 25 is moved towards the front support 42 (i.e., ends 112 contact the front support 42). Further, the end caps 70 function as stops to prevent movement of the wire basket 25 relative to the base portion 24 when they contact the rear support 44.

Figure 15:
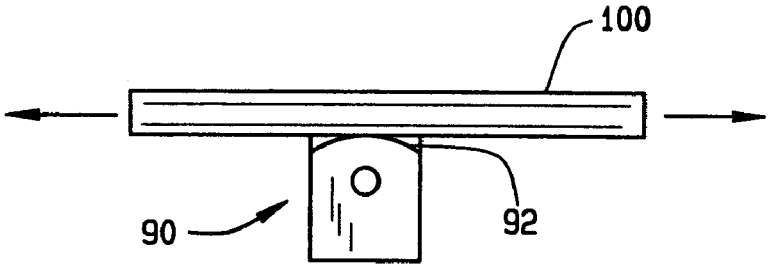
FIG. 15 is a partial back elevation view of a glide member of the present invention illustrating gliding movement of the present invention.

The first and second longitudinally extending storage portion support members 100 and 102 slide across the curved portion 92 of the glide member 90 as shown by the arrows in FIG. 15 to provide sliding movement of the wire basket 25 relative to the base portion 24. Further, removal of the wire basket 25 from the base portion 24 may be provided while maintaining the wire basket 25 substantially horizontal relative to the base portion 24. In particular, passage of the end caps 70 through the offset portion 50 and passage of the ends 112 of the second transversely extending storage portion support member 114 through the offset portion 50 allows for easily raising the wire basket 25 from the base portion 24. The handles 40 may be used by a user to facilitate the removal of the wire basket 25 from the base portion 24 and/or for transporting (e.g., carrying) the wire basket 25 once removed from the base portion 24.

It should be noted that the end caps 70 and glide members 90 may be constructed of any suitable material. In one embodiment, the end caps 70 and glide members 90 are constructed of Delrin® synthetic resin plastic. Further, the component parts of the storage portion 22 and base portion 24 may be constructed of any suitable material, such as, for example, steel.

Thus, the present invention provides a storage device, and in particular a wire basket providing easier installation, improving movement during operation that also provides longer operational life, and allowing for easier removal of a storage portion from a base portion while maintaining the storage portion generally horizontal.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An end cap for use with a storage device having a base portion and a storage portion formed by a plurality of wire members, the end cap comprising a first curved portion for engagingly receiving a portion of one of the wire members, and a first opening for engagingly receiving a portion of another one of the wire members, the end cap configured to facilitate sliding of the storage portion relative to the base portion when the end cap is engaged to the storage portion.

2. The end cap of claim 1, wherein the first curved portion is generally concave.

3. The end cap of claim 1, wherein the first curved portion includes a generally semi-circular transverse profile.

4. The end cap of claim 1, wherein the first curved portion and the first opening are oriented in generally perpendicular relation to one another to thereby allow the first curved portion to engagingly receive a portion of a longitudinally extending wire member of the storage portion, and the first opening to engagingly receive an end portion of a transversely extending wire member of the storage portion.

5. The end cap of claim 1, further comprising a second curved portion configured to facilitate sliding of the storage portion relative to the base portion without rolling of the end cap when the end cap is engaged to the storage portion.

6. The end cap of claim 5, wherein the second curved portion is generally convex.

7. The end cap of claim 6, wherein the second curved portion forms a bottom sliding surface of the end cap configured to facilitate sliding of the end cap within a channel of the base portion.

8. The end cap of claim 1, further comprising a second opening in communication with the first opening, the second opening allowing air to flow therethrough to facilitate positioning of a portion of a wire member into the first opening.

9. The end cap of claim 8, wherein the second opening is smaller than the first opening.

10. The end cap of claim 1, wherein the end cap is constructed of a Delrin® material.

11. The end cap of claim 1, wherein the end cap is configured to allow for removal of the storage portion from the base portion while the storage portion is maintained generally horizontal.

12. A storage device including a base portion, a storage portion formed by a plurality of wire members and slidably mounted to the base portion, and at least one end cap of claim 1 engaged to at least some of the plurality of wire members.

13. The storage device of claim 12, wherein the base portion includes a rear support, and wherein the end cap functions as a stop for inhibiting rearward sliding of the storage portion relative to the base portion when the end cap contacts the rear support.

14. A glide member for use with a storage device having a base portion and a storage portion formed by a plurality of wire members, the glide member comprising a mounting for attaching the glide member to the base portion, and a curved portion configured to facilitate sliding movement of at least one of the wire members across the curved portion relative to the base portion without rolling of the glide member when the glide member is attached to the base portion.

15. The glide member of claim 14, wherein the mounting includes a mounting opening for attaching the glide member to a first portion of the base portion.

16. The glide member of claim 15, wherein the mounting further includes a slot for engagingly receiving a second portion of the base portion for further securing the glide member to the base portion.

17. The glide member of claim 14, wherein the curved portion is generally convex.

18. The glide member of claim 17, wherein the generally convexly curved portion forms an upper surface of the glide member.

19. The glide member of claim 14, wherein the glide member is constructed of a Delrin® material.

20. A storage device including a base portion, a storage portion formed by a plurality of wire members and slidably mounted to the base portion, and at least one glide member of claim 19 attached to the base portion.

21. A storage system comprising a base portion, a storage portion formed by a plurality of wire members, the storage portion removably and slidably mounted to the base portion, and a plurality of end caps connected to end portions of at least some of the wire members, the plurality of end caps configured to allow for the removable connection of the storage portion to the base portion while the storage portion is maintained generally horizontal, the base portion including rails for aligning the storage portion relative to the base portion during sliding movement, the rails including an offset portion for allowing passage of the ends caps for removably connecting the storage portion to the base portion.

22. The storage system of claim 21, further comprising a plurality of glide members attached to the base portion and configured to facilitate the sliding movement of the storage portion relative to the base portion.

23. A method of slidably mounting a storage portion formed by a plurality of wire members to a base portion, the method comprising positioning a portion of one of the wire members within a curved portion of at least one end cap, positioning a portion of another one of the wire members within an opening of the end cap, and positioning the end cap within a channel of the base portion.

24. The method of claim 23, further comprising sliding the storage portion relative to the base portion by sliding a bottom portion of the end cap across a lower surface of the channel.

25. The method of claim 23, wherein positioning the end cap within the channel includes maintaining the storage portion generally horizontal.

26. The method of claim 23, wherein the base portion includes an offset portion for allowing passage of the end cap into and out of the channels, and wherein positioning the end cap with the channel includes positioning the end cap through the offset portion into the channel.

27. The method of claim 23, further comprising removing the storage portion from the base portion while maintaining the storage portion generally horizontal.

28. The method of claim 23, wherein the base portion includes an offset portion for allowing passage of the end cap into and out of the channels, and wherein the method further comprises removing the storage portion from the base portion by removing the end cap from the channel through the offset portion.

29. The method of claim 23, further comprising attaching to the base portion at least one glide member having a curved portion configured to facilitate sliding movement of at least one of the wire members across the curved portion without rolling of the glide member.

30. A method of slidably mounting a storage portion formed by a plurality of wire members to a base portion, the method comprising attaching to the base portion at least one glide member having a curved portion configured to facilitate sliding of at least one of the wire members across the curved portion without rolling of the glide member.

31. The method of claim 30, wherein the glide member includes a mounting opening, and wherein attaching the glide member includes using a fastener and the mounting opening to attach the glide member to a first portion of the base portion.

32. The method of claim 31, wherein the glide member includes a slot, and wherein attaching the glide member further includes positioning a second portion of the base portion within the slot to further secure the glide member to the base portion.

33. The method of claim 30, wherein the curved portion includes a generally convex upper surface of the glide member, and wherein the method includes sliding the storage portion relative to the base portion by sliding at least one of the wire members across the generally convex upper surface.

34. The method of claim 30, further comprising attaching at least one end cap to the storage portion by positioning a portion of one of the wire members within a curved portion of the end cap and positioning a portion of another one of the wire members within an opening of the end cap.

35. An end cap for use with a storage device having a base portion and a storage portion formed by a plurality of wire members, the end cap comprising:

a generally concave portion configured for engagingly receiving a generally horizontal portion of a first wire member;

a passage oriented generally perpendicular to the generally concave portion and configured for engagingly receiving a generally horizontal end portion of a second wire member generally perpendicular to the first wire member, the passage extending generally horizontally from a first opening sized for receiving the second wire member's end portion and terminating at a stop configured for inhibiting continued insertion of the second wire member's end portion into the passage when the second wire member's end portion contacts the stop;

a first generally convex portion;

a second generally convex portion disposed above the first generally convex portion, the second generally convex portion disposed below at least a portion of the generally concave portion;

the first and second generally convex portions configured to facilitate sliding of the end cap respectively along upper and lower surfaces of a channel associated with the base portion;

the end cap configured to allow for removal of the storage portion from the base portion while the storage portion is maintained generally horizontal.

36. A glide member for use with a storage device having a storage portion formed by a plurality of wire members, and a base portion with generally opposing side support members and generally opposing forward and rear support members, the glide member comprising:

at least one mounting opening for receiving at least one fastener for attaching the glide member to at least one of the support members of the base portion;

a slot extending lengthwise generally perpendicular to the at least one mounting opening, the slot configured for engagingly receiving a portion of the base portion therein for further securing the glide member to the base portion; and an upper curved portion configured to facilitate sliding movement of at least one of the wire members across the curved portion relative to the base portion without rolling of the glide member when the glide member is attached to the base portion.

* * * * *